US005453312A

United States Patent [19]

Haas et al.

[11] Patent Number: 5,453,312

[45] Date of Patent: Sep. 26, 1995

[54] ABRASIVE ARTICLE, A PROCESS FOR ITS MANUFACTURE, AND A METHOD OF USING IT TO REDUCE A WORKPIECE SURFACE

[75] Inventors: John D. Haas, Woodbury; Todd J. Christianson, Oakdale; Wesley J. Bruxvoort, Woodbury, all of Minn.

[73] Assignee: Minnesota Mining and Manufacturing Company, St. Paul, Minn.

[21] Appl. No.: 145,412

[22] Filed: Oct. 29, 1993

[51] Int. Cl.[6] ..... D06N 7/04; B32B 5/16

[52] U.S. Cl. ..... 428/143; 51/293; 51/304; 51/305; 428/328; 428/329; 428/331; 428/932

[58] Field of Search ..... 428/323, 328, 428/329, 331, 932, 143, 447; 51/293, 304, 305

[56] References Cited

U.S. PATENT DOCUMENTS

| | | | |
|---|---|---|---|
| 2,242,877 | 3/1939 | Albertson | 51/293 |
| 3,042,509 | 7/1962 | Soderburg | 51/305 |
| 4,035,162 | 7/1977 | Brothers et al. | 51/308 X |
| 4,255,164 | 3/1981 | Butzke et al. | 51/295 |
| 4,311,489 | 1/1982 | Kressner | 51/298 |
| 4,576,612 | 3/1986 | Shukla et al. | 51/295 |
| 4,652,275 | 3/1987 | Bloecher et al. | 51/298 |
| 4,751,138 | 6/1988 | Tumey et al. | 428/323 |
| 4,799,939 | 1/1989 | Bloecher et al. | 51/293 |
| 4,918,874 | 4/1990 | Tiefenbach, Jr. | 51/293 |
| 4,988,554 | 1/1991 | Peterson et al. | 428/142 |
| 5,014,468 | 5/1991 | Ravipati et al. | 51/295 |
| 5,015,266 | 5/1991 | Yamamoto | 51/293 |
| 5,037,451 | 8/1991 | Burnand et al. | 51/293 |
| 5,096,983 | 3/1992 | Gerber | 525/506 |
| 5,107,626 | 4/1992 | Mucci | 51/281 R |
| 5,152,917 | 10/1992 | Pieper et al. | 51/295 |
| 5,201,916 | 4/1993 | Berg et al. | 51/293 |
| 5,219,462 | 6/1993 | Bruxvoort et al. | 51/293 |
| 5,316,812 | 5/1994 | Stout et al. | 428/64 |

FOREIGN PATENT DOCUMENTS 2094824 9/1982 United Kingdom .

OTHER PUBLICATIONS

"SILWET™ Surface Active Copolymers", trade brochure publ. by Union Carbide Co., pp. 1–3, 5–7.

*Primary Examiner*—D. S. Nakarani
*Assistant Examiner*—H. Thi Lê
*Attorney, Agent, or Firm*—Gary L. Griswold; Walter N. Kirn; Ramon R. Hoch

[57] ABSTRACT

An abrasive article having a sheet-like structure having at least one major surface having deployed thereon a plurality of individual abrasive composites, each abrasive composite comprising a plasticizer and a plurality of abrasive particles dispersed in a binder, wherein said binder is formed by polymerizing a binder precursor and said plasticizer being combined with said binder precursor prior to said polymerizing in an amount of 30 to 70 parts plasticizer per 100 parts by weight of the combined binder precursor and plasticizer. There is also a method of using such as abrasive article to reduce the surface finish of a workpiece and a process of making the abrasive article.

16 Claims, 2 Drawing Sheets

ABRASIVE ARTICLE, A PROCESS FOR ITS MANUFACTURE, AND A METHOD OF USING IT TO REDUCE A WORKPIECE SURFACE

BACKGROUND OF THE INVENTION

1. Field of the Invention

This invention relates to an abrasive article having a sheet-like structure having deployed thereon a plurality of individual abrasive composites, each of which is comprised of a plurality of abrasive particles dispersed in a plasticized binder. The invention also relates to a process of making such as abrasive article and a method of using such an abrasive article to reduce a workpiece surface to impart a relatively fine surface on the workpiece being abraded.

2. Discussion of the Art

In general, abrasive articles comprise a plurality of abrasive particles bonded either together (e.g., a bonded abrasive or grinding wheel) or to a backing (e.g., a coated abrasive). These abrasive articles have been utilized to abrade and finish workpieces for well over a hundred years. Within the last several years, abrasive technology has grown to include structured abrasives. These abrasive articles are desirable because of their long life and high rate of stock removal. It has been seen that a structured abrasive can remove more stock than an abrasive coating employing the same size of abrasive particles.

Coated abrasives and structured abrasives can be employed for polishing operations, i.e., providing a very fine surface finish on the workpiece. However, when an ultrafine surface finish is desired, such as that required for an optical lens which require a clear surface finish, loose abrasive slurries are typically used.

However, the use of loose abrasive slurries for polishing and ultrafine finishing has drawbacks. For instance, the use of a loose abrasive slurry can be rather untidy as the extraneous slurry is thrown about in the work area by the motion of the lapping or polishing wheel or block. Also, the use of loose abrasive slurries can be less cost efficient as it may be difficult to estimate up front the minimal amount of needed abrasive material. This leads to the use of excessive amounts of abrasive, equipment and manpower. The industry has sought means to generate an ultrafine surface finish without the need to use a loose abrasive slurry.

A method for polishing using a solid abrasive polishing material has been proposed as a substitute for a loose abrasive slurry, such as disclosed in U.S. Pat. No. 3,042,509 to Soderburg. The abrasive material is constituted by a dispersion of abrasive particles in a binder where the binder is based on a water-soluble binder such as polyethylene glycol ester. Polyethylene glycol is blended with this water-soluble binder to provide a solid substance that is exemplified as formable into a stick-form that is urged against and applied to the outer surface of a buffing wheel.

To provide a hard and durable abrasive composite it has been proposed to form a mixture of abrasive particles and a temporary binder type material, such as polyethylene glycol, into a desired shape to obtain a green body as an intermediate product. The green body is sintered at high temperature to densify the abrasive body into a useful form that, concomitantly, acts to decompose and remove the temporary binder. For example, see U.S. Pat. Nos. 4,918,874 to Tiefenbach, Jr.; U.S. Pat. No. 3,765,300 to Taylor et al.; and U.S. Pat. No. 4,035,162 to Brothers et al.

The possible inclusion of plasticizers as an optional additive to an abrasive slurry based on a nonwater-soluble thermoset or reactively-cured binder in forming structured abrasive composites has been generally suggested without elaboration in several recent patents, such as U.S. Pat. Nos. 5,152,417 to Pieper et al. and 5,219,462 to Bruxvoort et al. Further, the use of a binder system in a structured abrasive composite that employs a binder polymerized via a free radical mechanism has been shown, such as in U.S. Pat. No. 5,152,179 to Pieper et al.

Also, U.S. application Ser. No. 08/030,787 (Christianson), filed Mar. 12, 1993, teaches a stone polishing abrasive article comprising radiation curable resin in a three-dimensional dot pattern. An amount of plasticizer, such as polyethylene glycol, of less than 30% based on weight of plasticizer and binder is mentioned as an additive for a binder, while the working examples describe usage of about 6 to 10% plasticizer. Additionally, the use of relatively small amounts of plasticizers such as polyethylene glycol, that is less than 10% by weight based on the weight of binder and plasticizer, in microfinishing beads or agglomerates also has been practiced to cause the beads to wear during a grinding process to expose new sharp mineral surfaces.

U.S. Pat. No. 4,255,164 to Butzke et al. disclose a glass fining sheet composed of a foamed liquid abrasive granule-resin coating composition. The resin is a cured modified resinous binder selected from urea-formaldehyde and phenol formaldehyde that has been modified by a thermoplastic polymeric modifier. The liquid coating composition comprises the liquid curable binder, abrasive fining granules and sufficient compatible solvent to provide a coatable composition. Such a coating provides a cellular layer which releases the fining abrasive granules at a controlled rate under use conditions. Butzke et al. also describe prior use of means to incorporate fining abrasive material into a cohesive layer so as to release abrasive material during glass grinding, but these means not having met with success. Prior attempts are also mentioned by Butzke et al. to cause the binder to disintegrate, dissolve or soften to free abrasive granules, such as by adding lubricants such as stearic acid, tallow, and paraffin wax. However, these prior attempts are described as unsatisfactory as the binder material disintegrates too rapidly and problems arose with respect to unmanageable frictional heat generation.

It has also been generally known to add polyalkylene oxides to resins that do not cure via a free radical mechanism, such a condensation curable resins such as phenolic resins. For instance, U.S. Pat. No. 4,576,612 to Shukla et al. describe an ophthalmic lens polishing pad where the polishing layer is produced by mixing a water soluble polyalkylene oxide/phenolic resin complex with an acrylic latex, and an alcohol slurry containing polishing particles. Shukla et al. state that the use of a water soluble polymer (polyalkylene oxide/phenolic resin mixture) exclusive of latex released polishing particles too rapidly with consequent poor polishing results. The polishing layer in Shukla et al. is provided as a continuous monolithic layer on a fabric substrate, or, alternatively, as a layer to completely cover or partially fill recesses in an embossed surface of the fabric substrate. The so-called thermoplastic matrix or binder system gradually dissolves during polishing to release polishing particles in a controlled manner to thus reportedly provide an acceptable glass removal rate.

However, while the use of such water soluble thermoplastic resin binder systems may be acceptable for simple abrasive coating layers or modified abrasive coating layers (e.g., embossed), the requirements for and demands placed upon the binder system generally will become more rigorous if a coated abrasive article is based on a more sophisticated arrangement, such as the deployment of individual abrasive beads or shaped abrasive composites upon the surface of a backing. The requirements there are heightened from the standpoint of manufacturing consistency, ease and rate, and from the standpoint of degree of control afforded over the ultimate shapes of the individual abrasive composites, which can be a critical design aspect. Also, the use of condensation curable resins, such as phenolic resins, in the binder system may not be tolerable in all cases in view of solvent emission considerations.

On the other hand, the provision of relatively large amounts of plasticizer in a binder that is cured via a free radical polymerization mechanism to provide an acceptable, if not desirable, erodable abrasive composite during finishing operations is not thought to have been taught before.

SUMMARY OF THE INVENTION

This invention relates to an abrasive article and its usage to impart a very fine surface finish with low surface roughness. The abrasive article has a sheet-like structure having deployed thereon a plurality of individual abrasive composites, each comprising a plurality of abrasive particles adhered together with a plasticized binder, which contains at least a prescribe amount of plasticizer.

For purposes of this invention, a "plasticizer" is an organic material which when combined with binder to form a "plasticized binder" will increase the erosion rate of the abrasive composites in an abrasive article of the invention when used to refine a workpiece surface as compared to the rate of erosion the abrasive composite of a similar abrasive article which does not contain at least the prescribed amount of plasticizer. The erosion rate can be quantified by an "erodability index" which is determined in a manner described in U.S. Pat. No. 4,255,164 to Butzke et al.

In one embodiment, this invention relates to an abrasive article including a sheet-like structure having at least one major surface having deployed thereon a plurality of individual abrasive composites, each abrasive composite comprising a plurality of abrasive particles dispersed in a plasticized binder, and the binder having been formed by polymerization of a binder precursor, wherein the binder precursor is combined with a plasticizer prior to the polymerization in an amount of 30 to 70 parts plasticizer per 100 parts by weight of the combined binder precursor and plasticizer.

In a one preferred embodiment, the plasticizer is selected from among polyols, organosilicone oils, and combinations thereof.

In one further embodiment, the aforesaid abrasive article includes a plasticizer that is a polyol selected from the group consisting of polyethylene glycol, methoxypolyethylene glycol, polypropylene glycol, polybutylene glycol, glycerol, polyvinyl alcohol, and combinations thereof. More preferably, the polyol is selected to be polyethylene glycol, such as a polyethylene glycol having an average molecular weight of from 200 to 10,000. Polyethylene glycol is especially useful as used in an amount 30 to 50 parts plasticizer per 100 parts by weight of the combined binder precursor and polyethylene glycol plasticizer.

In one alternate embodiment of the abrasive article of the invention, the plasticizer can be selected to be a silicone oil. In one further embodiment, the silicone oil is a polyalkylene oxide modified polymethylpolysiloxane, such as represented by the general formula I:

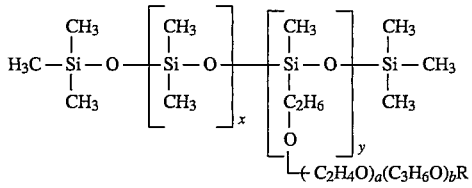

I wherein R represents either a hydrogen or a lower alkyl group, and a, b, x and y each represents a positive integer.

In another embodiment of the abrasive article of the invention, the aforesaid binder precursor is one that is cured or polymerized via an addition polymerization mechanism, and preferably via a free radical mechanism. Suitable binder precursors in this regard include acrylated urethanes, acrylated epoxies, ethylenically unsaturated compounds, aminoplast derivatives having pendant α,β-unsaturated carbonyl groups, isocyanurate derivatives having at least one pendant acrylate group, isocyanate derivatives having at least one, pendant acrylate group, and combinations thereof. In a preferred embodiment, the binder precursor comprises an ethylenically unsaturated compound, such as an acrylate monomer. In a more preferred embodiment, the binder precursor is trimethylolpropane triacrylate.

In yet another embodiment of the abrasive article of the invention, the abrasive particles used in the abrasive composites are a material selected from the group consisting of aluminum oxide, silicon carbide, chromia, alumina zirconia, silica, diamond, iron oxide, ceria, boron nitride, boron carbide, garnet, and combinations thereof. In another embodiment, the abrasive particles have a Mohs' hardness of at least 8 and a particle size of from about 0.1 to 500 micrometers, and more preferably, the abrasive particles have a size of from 0.1 to 5 micrometers.

In one preferred embodiment of the abrasive article of the invention, the abrasive composites each have a precise shape defined by a distinct and discernible boundary, and, further, the abrasive composites each comprise a distal end that is spaced from the major surface of the backing and is unconnected to any other composite.

In an alternate embodiment of the abrasive article of the invention, there is a sheet-like structure having at least one major surface having deployed thereon a plurality of abrasive particles dispersed in a plasticized binder, and the binder having been formed by polymerization of binder precursor comprising a resin polymerized via an addition mechanism, wherein the binder precursor is combined with plasticizer prior to the polymerization in an amount of 30 to 70 parts plasticizer per 100 parts by weight of the combined binder precursor and the plasticizer.

In yet another alternate embodiment of the abrasive article invention, there is a sheet-like structure having at least one major surface having deployed thereon an abrasive material comprising a plurality of abrasive particles dispersed in a binder, wherein the abrasive material is provided as a discontinuous raised pattern formed of a plurality of elongated three-dimensional formations extending from the major surface which define areas having no abrasive material, wherein the binder is formed from a binder precursor that is combined with plasticizer prior to the polymerization in amount of 30 to 70 parts plasticizer per 100 parts by weight of the combined binder precursor and plasticizer.

In another embodiment of the invention, there is a method of refining a workpiece, comprising the steps of:

(a) bringing into frictional contact a workpiece having a surface and an abrasive article, wherein the abrasive article comprises a sheet-like structure having at least one major surface having deployed thereon a plurality of individual abrasive composites, each abrasive composite comprising a plurality of abrasive particles dispersed in a plasticized binder, and the binder having been formed by polymerization of a binder precursor, wherein the binder precursor is combined with a plasticizer prior to the polymerization in an amount of 30 to 70 parts plasticizer per 100 parts by weight of the combined binder precursor and plasticizer; and (b) moving at least one of the abrasive article and the workpiece surface whereby the surface roughness of the workpiece is reduced. In a further embodiment, relative movement between the abrasive article and workpiece involves a rotational and/or oscillatory movement, such as provided by a lap apparatus.

In a preferred embodiment of the method for refining a workpiece according to the invention, the abrasive article and workpiece surface are contacted at their interface with a liquid, such as water, that is substantially free of abrasive particles during the abrading movement. Also, the abrasive article and the workpiece surface contact at an interface, and the moving can be conducted under a frictional contact force at the interface of 1 to 500 kg. The type of workpiece material is not particulary limited, and includes materials such as metals, metal alloys, ceramics, glass, wood, composites, painted surfaces, plastics, stone and marble. The workpiece can be in a plastic lens form.

In another embodiment of the invention, there is a process for making an abrasive article of the invention comprising the steps of:

(a) preparing a slurry comprising plasticizer, a plurality of abrasive particles, and binder precursor as a liquid medium, to provide 30 to 70 parts plasticizer per 100 parts by weight binder precursor plus plasticizer;

(b) providing a backing having a front surface and a back surface, and a production tool having a contact surface which includes a plurality of cavities, each cavity having a precise shape defined by a distinct and discernible boundary;

(c) providing means to apply the slurry into the cavities;

(d) contacting the front surface of the backing with the contact surface of the production tool such that the slurry in each cavity contacts and wets areas on the front surface of the backing;

(e) solidifying the binder precursor to form a binder within the cavities, whereupon solidification the slurry is converted into a plurality of abrasive composites; and (f) separating the production tool from the backing after the solidifying to provide a plurality of abrasive composites attached to the front surface of the backing.

Other features, advantages, and constructs of the invention will be better understood from the following description of the drawings and the preferred embodiments of the present invention.

DESCRIPTION OF THE PREFERRED EMBODIMENTS

Figure 1:
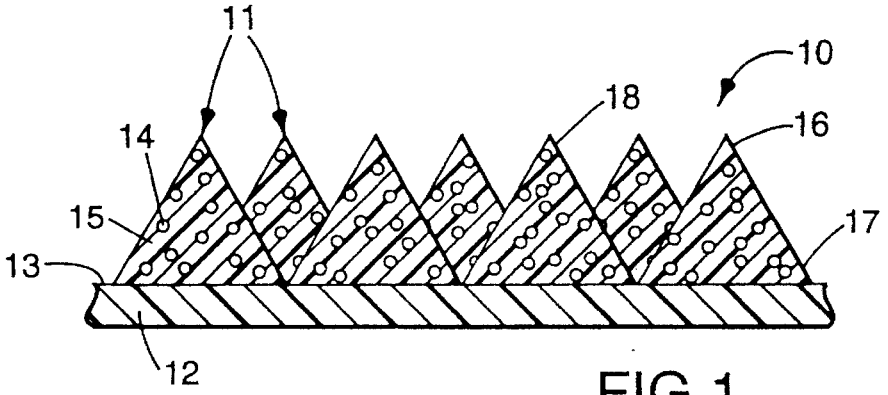
FIG. 1 is an enlarged end sectional view showing one type of abrasive article of this invention.

This invention relates to an abrasive article and its usage to impart a very fine surface finish with low surface roughness on a workpiece. The abrasive article is especially useful for polishing operations. It has been discovered, quite surprisingly, that the presence of a requisite amount of plasticizer in the binder employed to adhere the abrasive granules together to form abrasive composites has been found to generate a "super erodable" abrasive system with significant advantages. The weight of plasticizer by weight to achieve this benefit should be at least about 30% of the combined weight of plasticizer plus precursor material which forms the binder.

While not desiring to be bound to any theory at this time, it nonetheless is thought that usage of the prescribed amount and type of plasticizer contemplated in this invention causes the abrasive particles to be less rigidly held by the binder system so that the binder matrix flexes to more easily liberate abrasive particles during abrading or polishing.

For instance, the plasticized binder is softened such that wild scratches are not caused when polishing where chips of the composite material contact a lens being polished. When the abrasive article of the present invention is put into service, such as in an optical lens polishing operation, a breakdown of composites is observed at the exposed surface regions of the abrasive composites where small chunks of abrasive particles and neighboring binder material are loosened and liberated from the working surfaces of the abrasive composite, and new or fresh abrasive particles are exposed. This breakdown process continues during polishing at the newly exposed surface regions of the abrasive composites. As a result of this breakdown, it is theorized that gouging of the workpiece surface by the abrasive particles is reduced, and, thus, a finer surface finish is provided. The plasticizers are also thought to combine with the binder to provide a cushioning effect in the abrasive composites.

Another surprising advantage of the invention has been found to be that certain relatively large amounts of a plasticizer, such as polyethylene glycol or silicone oil, can be successfully incorporated into the binder system of an abrasive composite to effectively displace one-for-one amounts of the typically more costly binder precursor, which otherwise would be needed. For instance, in the present invention, for every 100 parts by weight of the mixture of binder precursor and plasticizer used in the binder system of the invention, the amount of plasticizer is increased to at least 30 parts while the amount of binder precursor is maintained below 70 parts, based 100 parts by weight per 100 parts by weight of the mixture of plasticizer and binder precursor. This proviso clearly departs from prior binder systems using relatively small amounts of plasticizer where the amount of binder precursor overwhelmingly dominated the binder system in amounts representing greater than 70% by weight of the binder system.

In the present invention, the amount of plasticizer vis-a-vis the binder precursor can be increased up to an amount above 30% by weight based on weight of plasticizer plus binder precursor just short of where the adhesive bond strength between the abrasive composite and a backing might be rendered inadequate. Also, if the backing is primed with an adhesive coating, this upper amount of plasticizer can often be increased to an even higher value. Generally, the upper limit amount of plasticizer will not exceed 70% plasticizer based on weight of plasticizer plus binder precursor.

For instance, when polyethylene glycol is employed as the plasticizer, amounts of greater than about 50% polyethylene glycol in the binder system may not be suitable for the abrasive composites, after cure, are observed to shed easily from a backing during usage. However, if the backing is primed with an extraneous adhesive before and at the time of contacting the abrasive slurry, this amount of polyethylene glycol often can be increased.

Referring to FIG. 1, the abrasive article 10 has a backing 12 which includes a front surface 13 having a plurality of abrasive composites 11 bonded thereto. The abrasive composites comprises a plurality of abrasive particles 14 dispersed in the plasticized binder 15.

Backing

Any conventional backing material may be employed as a support for the abrasive composites of this invention. Examples of suitable backing materials include those made of polymeric film, primed polymeric film, cloth, paper, vulcanized fiber, nonwovens, and combinations thereof. The preferred backing is paper. The backing may also contain a treatment or treatments to seal the backing and/or modify some physical properties, such as water resistivity. These treatments are well known in the art. The backing typically is flat surfaced and nonembossed.

The backing may also have an attachment means on its back surface to secure the resulting coated abrasive to a support pad or back-up pad. This attachment means is usually a pressure sensitive adhesive, but a loop fabric for a hook and loop attachment is also viable. Alternatively, there may be a intermeshing attachment system as described in U.S. Pat. No. 5,201,101 (Rouser et al.).

Abrasive Composite

Abrasive Particles

The abrasive particles typically have a particle size ranging from about 0.1 to 500 micrometers, usually between about 0.1 to 100 micrometers, preferably between 0.1 to 10 micrometers, and more preferably between 0.1 to 5 micrometers. It is preferred that the abrasive particles have a Mohs' hardness of at least about 8, more preferably above 9. Examples of such abrasive particles include fused aluminum oxide (which includes brown aluminum oxide, heat treated aluminum oxide, and white aluminum oxide), ceramic aluminum oxide, silica, green silicon carbide, silicon carbide, chromia, alumina zirconia, diamond, iron oxide, ceria, cubic boron nitride, boron carbide, garnet, and combinations thereof.

The term abrasive composite also encompasses when single abrasive particles are bonded together to form an abrasive agglomerate. The abrasive agglomerates can have a predetermined three-dimensional shape associated with them. Abrasive agglomerates are further described in U.S. Pat. Nos. 4,311,489 (Kressner), 4,652,275 (Bloecher et al.), and 4,799,939 (Bloecher et al.), which are incorporated herein by reference.

It is also within the scope of this invention to have a surface coating on the abrasive particles. The surface coating may have any of a variety of different functions. In some instances the surface coating may increase adhesion to the binder, and/or alter the abrading characteristics of the abrasive particle. Other modifications are also possible. Examples of surface coatings include materials which act as coupling agents and halide salts, metal oxides including silica to increase adhesion, refractory metal nitride, refractory metal carbides, and the like.

The abrasive composite may also include diluent particles. The particle size of these diluent particles may be on the same order of magnitude as the abrasive particles. Examples of such diluent particles include gypsum, marble, limestone, flint, silica, glass bubbles, glass beads, aluminum silicate, and the like.

Binder System

The abrasive particles are dispersed in a binder system to form the abrasive composite. The binder system contains, in the main, binder component and plasticizer component. The plasticizer is preferably selected so that it does not cause the binder or binder precursor to crosslink and will not copolymerize with the binder precursor or binder. In general, the plasticizer is unreactive in the presence of the binder precursor or binder, or other components in the abrasive composite, during both the manufacture and usage of the abrasive article. It is preferred that each of the abrasive particles and plasticizer are uniformly mixed with the binder precursor throughout the abrasive composite.

Plasticizers-Binder-Abrasive Particle Interaction

During use of the abrasive article of this invention, the abrasive composite gradually erodes. This erodability property is helpful to obtain the fine surface finish on the workpiece surface, such as optical lens surface. This erodability allows worn abrasive particles to be gradually expelled at a rate sufficient to expose new abrasive particles. It is believed that this erodability rate prevents the worn abrasive particles from creating deep and wild scratches in the lens surface.

This erodability rate can depend upon many factors including the abrasive composite formulation and the grinding conditions. The abrasive composite formulation, the abrasive particle type, abrasive particle size, binder type, optional additives, individually or in combination may effect erodability of the abrasive composite. For instance, certain additives or fillers, such as glass bubbles, tend to make the abrasive composite more erodible.

It is also theorized that a softer abrasive composite helps the resulting abrasive article produce a finer surface finish in the workpiece. Although not desiring to be bound to any theory at this time, it is believed that the softer abrasive composite provides a cushion effect during polishing, thereby leading to a finer finish to help eliminate the need for an abrasive slurry.

There are several means to provide a soft abrasive composite. One means is to use a relatively soft binder, such as acrylate monomers, acrylated urethane oligomers, epoxies, vinyl ethers and the like. Generally, the soft binders will have a Knoop hardness less than about 25, generally less than about 20. These soft binders typically can enable the achievement of a sufficiently erodable composite system to be provided during polishing without the need for extraneous plasticizers to impart a requisite softness.

On the other hand, the primary focus of this invention is the discovery of providing a soft flexible abrasive composite by inclusion of certain plasticizers in certain relatively high amounts in the abrasive composites. The plasticizers as used in this invention increase the erodability of the abrasive composite.

The binder system of this invention contains from 30% to 70% plasticizer by weight based on total weight plasticizer and binder precursor. Preferably at least 35% by weight plasticizer is used based on the amount of binder precursor and plasticizer, and more preferably at least 40% by weight plasticizer is used based on the amount of binder precursor and plasticizer. The type of plasticizer used may also effect the optimal weight amount of no less than 30% plasticizer based on binder precursor plus plasticizer. In many instances, the plasticizer of the invention is typically less costly than the binder precursors. Therefore, the one-for-one displacement of binder precursor with the relatively higher amounts of plasticizer as in the invention may provide significant cost savings.

The plasticizer can be water soluble or water insoluble. However, the plasticizer should be compatible with the binder and binder precursor, although it is not required that the plasticizer form a homogeneous mixture with the binder precursor after their mixing and before curing of the binder precursor. It is preferred that the plasticizer not phase separate from the binder precursor, although this is not thought to be essential. Preferably, the plasticizer is uniformly mixed with the binder precursor.

Examples of plasticizers within the contemplation of this invention include certain polyols and silicone oils. For example, the polyol can be selected from the group consisting of polyethylene glycol, methoxypolyethylene glycol, polypropylene glycol, polybutylene glycol, glycerol, polyvinyl alcohol, and combinations thereof.

In one preferred embodiment of the invention, the plasticizer is selected to be a polyalkylene oxide. Polyethylene glycol is especially preferred as it is a nonreactive oligomer in the environment of the invention and is soluble in a variety of monomers. Preferably, these monomers are ethylenically unsaturated compounds such as those including acrylate monomers. One such monomer is trimethylol propane triacrylate (TMPTA), which is a preferred binder precursor in the invention. When mixed together, polyethylene glycol and TMPTA give a clear solution, and abrasive particles can be incorporated along with known rheology agents to provide a slurry formulation which can be conveniently shaped and cured in-situ in a production tool to provide structured abrasive composites. For purposes of this invention, the polyethylene glycol can be mixed with TMPTA binder precursor in proportional amounts by weight of 30/70 to about 50/50, respectively. Amounts of higher than 50 parts polyethylene glycol in the TMPTA have been observed to encounter increased shedding problems as the composites adhere to an unprimed paper backing with less tenacity. The polyethylene glycol used in this invention is water soluble, typically completely water soluble, and has a molecular weight of from about 200 to 10,000. Polyethylene glycol can be combined with the binder precursor in liquid form, solid form, or a combination thereof, without any particular limitation as to its physical state.

The silicone oils usable as a plasticizer in this invention are preferably organofunctional silicone oils such as polyalkylene oxide- modified dimethyl-polysiloxanes, which are copolymers. Suitable silicone oils of this type are commercially available under the tradename series SILWET® from Union Carbide Chemical and Plastics Co., Inc., Danbury Conn. USA. These silicone oils can be represented by the general formula I:

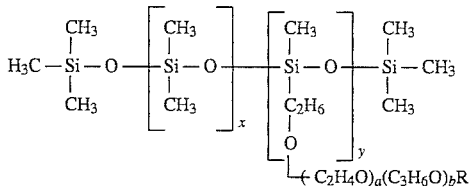

I where R can be either a hydrogen atom or a lower alkyl (1–8 C) group, and a, b, x and y each represents a positive integer. For example, SILWET® Surfactant L-77 has been found to impart a suitable erodability in the abrasive composites when used in the amounts of the invention. SILWET® Surfactant L-77 is a water soluble polyalkylene modified heptamethyltrisiloxane identified by Chemical Abstracts Service (CAS) No. 27306-78-1 as alpha-1,1,1,3,5,5,5-heptamethyltrisiloxanylpropyl-omega-Methoxy-Poly(ethyleneoxide). SILWET® L-7500 also is suitable for use as a plasticizer in this invention, which is a water-insoluble silicone oil.

Other suitable silicone oils for use as the plasticier in this invention include commercially available SILWET® Surfactants L-720 and L-722 having Si-O-C bonds, which can be represented by the following formula II:

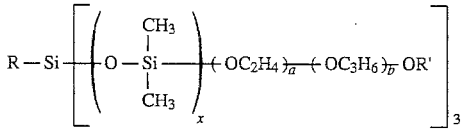

II where R and R' are lower alkyl groups, and a, b and x each represents a positive integer. The lower alkyl groups in formulae I and II generally cover straight or branched chain alkyl groups having 1–8 carbon atoms. The coefficients a, b, x and y have a value of at least one in formulae I and II.

Binder

The binder of the current invention is a thermosetting crosslinked binder that is formed by polymerization of a binder precursor via an addition (chain reaction) mechanism inclusive of a free radical mechanism and a cationic mechanism. The meaning of these terms, such as "addition" or "chain reaction" polymerization, "free radical" mechanism or "cationic" mechanism are well known, and are described, for example, in the *Textbook of Polymer Science,* Third Edition, F. Billmeyer, Jr., John Wiley & Sons, New York, N.Y., 1984. Preferably, the binder is formed from a binder precursor polymerized via a free radical mechanism. During the manufacture of the abrasive article, the binder precursor is exposed to an energy source which aids in the initiation of the polymerization or curing process. Examples of energy sources include thermal energy and radiation energy which includes electron beam, ultraviolet light, and visible light. Depending upon the energy source that is utilized and the binder precursor chemistry, a curing agent, initiator, or catalyst is sometimes preferred to help initiate the polymerization. After this polymerization process, the binder precursor is converted into a solidified binder.

The binder in the abrasive composite is generally also responsible for adhering the abrasive composite to the front surface of the backing. However, in some instances there may be an additional adhesive layer between the front surface of the backing and the abrasive composite.

Examples of suitable binder precursors curable by a free radical mechanism for this invention include acrylated urethanes, acrylated epoxies, ethylenically unsaturated compounds, aminoplast derivatives having pendant α,β-unsaturated carbonyl groups, isocyanurate derivatives having at least one pendant acrylate group, isocyanate derivatives having at least one pendant acrylate group, and mixtures and combinations thereof. The term acrylate encompasses acrylates and methacrylates.

Acrylated urethanes are diacrylate esters of hydroxy terminated NCO extended polyesters or polyethers. Examples of commercially available acrylated urethanes include UVITHANE 782, available from Morton Thiokol Chemical, and CMD 6600, CMD 8400, and CMD 8805, available from Radcure Specialties.

Acrylated epoxies are diacrylate esters of epoxy resins, such as the diacrylate esters of bisphenol A epoxy resin. Examples of commercially available acrylated epoxies include CMD 3500, CMD 3600, and CMD 3700, available from Radcure Specialties.

Ethylenically unsaturated resins include both monomeric and polymeric compounds that contain atoms of carbon, hydrogen, and oxygen, and optionally, nitrogen and the halogens. Oxygen or nitrogen atoms or both are generally present in ether, ester, urethane, amide, and urea groups. Ethylenically unsaturated compounds preferably have a molecular weight of less than about 4,000 and are preferably esters made from the reaction of compounds containing aliphatic monohydroxy groups or aliphatic polyhydroxy groups and unsaturated carboxylic acids, such as acrylic acid, methacrylic acid, itaconic acid, crotonic acid, isocrotonic acid, maleic acid, and the like. Representative examples of acrylate resins include methyl methacrylate, ethyl methacrylate styrene, divinylbenzene, vinyl toluene, ethylene glycol diacrylate, ethylene glycol methacrylate, hexanediol diacrylate, triethylene glycol diacrylate, trimethylolpropane triacrylate, glycerol triactylate, pentaerythritol triacrylate, pentaerythritol methacrylate, pentaerythritol tetraacrylate and pentaeuthritol tetraacrylate. Other ethylenically unsaturated resins include monoallyl, polyallyl, and polymethallyl esters and amides of carboxylic acids, such as diallyl phthalate, diallyl adipate, and N,N-diallyladipamide. Still other nitrogen containing compounds include tris(2-acryloyl-oxyethyl)isocyanurate, 1,3,5-tri(2-methyacryloxyethyl)-s-triazine, acrylantide, methylacrylamide, N-methylacrylamide, N,N-dimethylacrylamide, N-vinylpyrrolidone, and N-vinylpiperidone.

The aminoplast resins have at least one pendant alpha, beta-unsaturated carbonyl group per molecule or oligomer. These unsaturated carbonyl groups can be acrylate, methacrylate, or acrylamide type groups. Examples of such materials include N-(hydroxymethyl)acrylamide, N,N'-oxydimethylenebisacrylamide, ortho and para acrylamidomethylated phenol, acrylamidomethylated phenolic novolac, and combinations thereof. These materials are further described in U.S. Pat. Nos. 4,903,440 (Larson et al.) and 5,236,472 (Kirk et al.), each of which is incorporated herein by reference.

Isocyanurate derivatives having at least one pendant acrylate group and isocyanate derivatives having at least one pendant acrylate group are further described in U.S. Pat. No. 4,652,274 (Boettcher et al.) incorporated herein by reference. The preferred isocyanurate material is a triacrylate of tris(hydroxy ethyl) isocyanurate.

Vinyl ethers are exemplary of binder precursors curable via a cationic mechanism to form the binder.

The use in this invention of binder systems which cure via an addition (chain reaction) mechanism provides significant advantages over thermoplastic binder systems as the former can be rapidly and controllably cured by exposure to radiation energy to permit a high rate of production while affording a high degree of control over ultimate shape of the abrasive composites. Also, the binder precursors which cure via a free radical or cationic mechanism pose less of a problem from the standpoint of solvent emissions as compared to condensation curable resins.

Regarding free radical curable resins used in this invention, in some instances it is preferred that the abrasive slurry further comprise a free radical curing agent. However in the case of an electron beam energy source, the curing agent is not always required because the electron beam itself generates free radicals.

Examples of free radical thermal initiators include peroxides, e.g., benzoyl peroxide, azo compounds, benzophenones, and quinones. For either ultraviolet or visible light energy source, this curing agent is sometimes referred to as a photoinitiator. Examples of initiators, that when exposed to ultraviolet light generate a free radical source, include but are not limited to those selected from the group consisting of organic peroxides, azo compounds, quinones, benzophenones, nitroso compounds, acryl halides, hydrozones, mercapto compounds, pyrylium compounds, triacrylimidazoles, bisimidazoles, chloroalkytriazines, benzoin ethers, benzil ketals, thioxanthones, and acetophenone derivatives, and mixtures thereof. Examples of initiators that when exposed to visible radiation generate a free radical source, can be found in U.S. Pat. No. 4,735,632 (Oxman et al.), entitled Coated Abrasive Binder Containing Ternary Photoinitiator System incorporated herein by reference. The preferred initiator for use with visible light is "Irgacure 369" commercially available from Ciba Geigy Corporation.

Additives

The abrasive slurry can further comprise optional additives, such as, for example, fillers (including grinding aids), fibers, lubricants, wetting agents, thixotropic materials, surfactants, pigments, dyes, antistatic agents, coupling agents, and suspending agents. The amounts of these materials are selected to provide the properties desired. The use of these can affect the erodability of the abrasive composite. Although not thought to be essential to the present invention, in some instances, an additive, such as clay, can be added to afford even more control over the erodability of the abrasive composite in terms of expulsion of dulled abrasive particles and exposure of new abrasive particles.

The term filler also encompasses materials that are known in the abrasive industry as grinding aids. A grinding aid is defined as particulate material that the addition of which has a significant effect on the chemical and physical processes of abrading which results in improved performance. Examples of chemical groups of grinding aids include waxes, organic halide compounds, halide salts and metals and their alloys. Examples of such materials include chlorinated compounds like tetrachloronaphtalene, pentachloronaphthalene; and polyvinyl chloride. Examples of halide salts include sodium chloride, potassium cryolite, sodium cryolite, ammonium cryolite, potassium tetrafluoroborate, sodium tetrafluoroborate, silicon fluorides, potassium chloride, magnesium chloride. Examples of metals include, tin, lead, bismuth, cobalt, antimony, cadmium, iron, and titanium. Other miscellaneous grinding aids include sulfur, organic sulfur compounds, graphite and metallic sulfides.

Examples of antistatic agents include graphite, carbon black, vanadium oxide, humectants, and the like. These antistatic agents are disclosed in U.S. Pat. Nos. 5,061,294 (Harmer et al.), 5,137,542 (Buchanan et al.), and 5,203,884 (Buchanan et al.) incorporated herein by reference.

A coupling agent can provide an association bridge between the binder precursor and the filler particles or abrasive particles. Examples of coupling agents include silanes, titanates, and zircoaluminates. The abrasive slurry preferably contains anywhere from about 0.01 to 3% by weight coupling agent.

An example of a suspending agent is an amorphous silica particle having a surface area less than 150 meters square/gram that is commercially available from DeGussa Corp., under the trade name "AEROSIL 130".

Abrasive Composite Shape

The preferred abrasive article for use with the present invention employs an array of individual abrasive composites, each composite comprising abrasive particles dispersed in a binder system. In this preferred embodiment, each composites is three dimensional in shape and presents an independent acting grinding surface apart from other composites during usage. These individual abrasive composites used in this invention can be used as an agglomerate or beaded type abrasive article or a so-called "structured abrasive article." A structured abrasive article means an abrasive article wherein a plurality of individual precisely-shaped composites are disposed on a backing in an array, each composite comprising abrasive particles dispersed in a binder. A structured abrasive article, of this preferred embodiment, does not encompass a monolithic coating or modified (e.g., embossed or discontinuous raised pattern) coating of abrasive particles dispersed in a binder.

Thus, for the embodiment where the composites are "individual" in nature, each abrasive composite has a shape associated with it. The shape of an individual composite has a surface or boundaries associated with it that results in one abrasive composite being separated to some degree from another adjacent abrasive composite. Preferably, the abrasive composites have shapes which are separated at least at their distal ends even if the base ends bonded to the backing are abutting one another. To form an individual abrasive composite, a portion of the planes or boundaries forming the shape of the abrasive composite must be separated from one another. This portion is generally the upper portion. The lower or bottom portion of the abrasive composites can abut next to one another. Referring to FIG. 1, adjacent abrasive composites 11 may be separated near the top surface 16 and abutted near the bottom surface 17. That is, to form an individual abrasive composite, the planes and boundaries forming the shape of the abrasive composite must be separated from one another at least at the distal ends at the upper portions of the abrasive composite shapes. These distal ends can all extend to a common imaginary plane extending parallel to the backing, or can have independent heights from each other. The lower or bottom portion of abrasive composites, but not inclusive of the distal ends, can abut next to one another.

Thus, the abrasive composites of the preferred embodiment of this invention are characterized as being "individual" in the sense that at least the distal ends of different composites do not interconnect. Instead, at least the distal ends present independent abrading surfaces against the workpiece. This proviso is thought to provide an array of separate more flexible grinding members to enhance the finishing effect.

The individual abrasive composite shape can be any be shape, but it is preferably a geometric shape such as a pyramid, truncated pyramid, cubic, rectangular, prismatic, conical, truncated conical, or a cylinder or post-like feature having a top surface shape of triangle, square, rectangle, hexagon, octagon, or the like. The resulting abrasive article can have a mixture of different abrasive composite shapes.

A preferred shape is a pyramid or truncated pyramid. The pyramidal shape preferably has four to five sides if untruncated and five to six sides if truncated (inclusive of the base side), although a larger number of sides also is within the scope of the invention. It is preferred to provide a height of the composites which is constant across the abrasive article, but it is possible to have composites of varying heights. The height of the composites can be a value of up to about 200 micrometers, especially 25 to about 200 micrometers. Where a pyramidal or truncated pyramidal shape is used, the base side lengths generally can have a length of from about 100 to 500 micrometers.

It is preferred that this shape of the abrasive composite be precise or predetermined as defined by a distinct and discernible boundary when viewed under a microscope, such as a scanning electron microscope. Such a precise shape is illustrated in FIG. 1. The abrasive article 10 comprises a backing 12 and bonded to the backing are a plurality of abrasive composites 11. Inside the abrasive composites are a plurality of abrasive particles 14 dispersed in a bond system 15. The bond system consists of a free radical cured binder and a plasticizer. In this particular illustration, the abrasive composite has a pyramidal type shape. The planes 18 or boundaries 18 which define the pyramid are very sharp and distinct.

For purposes of this invention, the expression "precisely-shaped" and the like, as used to describe the abrasive composites, refers to abrasive composites having a shape that is defined by relatively smooth-surfaced sides that are bounded and joined by well-defined sharp edges having distinct edge lengths with distinct endpoints defined by the intersections of the various sides.

For purposes of this invention, the term "boundary" as used herein to define the abrasive composites, means the exposed surfaces and edges of each composite that delimit and define the actual three-dimensional shape of each abrasive composite. These boundaries are readily visible and discernible when a cross-section of an abrasive article of this invention is viewed under a scanning electron microscope. These boundaries separate and distinguish one abrasive composite from another even if the composites abutt each other along a common border at their bases. By comparison, in an abrasive composite that does not have a precise shape, the boundaries and edges are not definitive, e.g., where the abrasive composite sags before completion of its curing.

Figure 2:
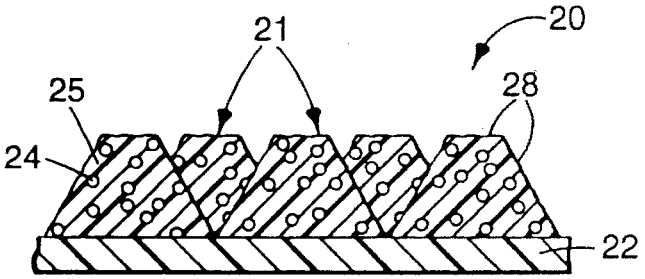
FIG. 2 is an enlarged end sectional view showing another type of abrasive article of this invention.

FIG. 2 illustrates an abrasive composite that has an irregular shape. The abrasive article 20 comprises a backing 22 and bonded to the backing are a plurality of abrasive composites 21. Inside the abrasive composites are a plurality of abrasive particles 24 dispersed in a bond system 25. In this particular illustration, the abrasive composite has a truncated pyramidal type shape. The planes 28 or boundaries 28 which define the feature are imperfect and inexact. The imperfect shape can be caused by permitting the abrasive slurry to flow or sag from the initial shape prior to curing or solidification of the binder precursor, for example, by prematurely removing the production tool from the backing before the composites have sufficiently cured to hold the shape imparted by a production tool. These non-straight, non-clear, non-reproducible, inexact or imperfect planes or shape boundaries is what it is meant by an irregular shape.

Alternatively, the individual abrasive composites can be provided as abrasive agglomerates or beads, such as described in U.S. Pat. Nos. 4,311,489, 4,652,275, and 4,799,939; but which are modified for purposes of this invention to increase the erodability by means described herein.

It is preferred that there are at least 700 individual abrasive composites/square centimeter, preferably at least 1,500, more preferably at least 3,000 and most preferably at least 7,500 individual abrasive composites/square centimeter. These areal spacing numbers for abrasive composites result in an abrasive article that has a relatively high rate of cut, a long life, but also results in a relatively fine surface finish on the workpiece being abraded. In some instances, these composite densities can result in a more consistent breakdown the abrasive composite.

Alternatively, it is contemplated that the abrasive composites used in the invention can be formed as an interconnecting network or grid on a backing as formed of a cured slurry of the abrasive particles dispersed in a binder of the types disclosed herein. The network can be a grid configuration where interconnected ridges of the abrasive material, such as applied to a backing by a rotogravure roll, enclose openings devoid of abrasive material. In this embodiment, the abrasive material is discontinuously applied to or formed on the backing to provide elongate ridges of abrasive material that are interconnected including at distal ends. This embodiment of the invention provides for a raised pattern of abrasive material, such as including the patterns mentioned in U.S. Pat. No. 4,733,920 and U.S. Pat. No. 5,014,469; although the abrasive material is modified for purposes of this invention by means disclosed herein to provide an erodable abrasive material, particularly by a type and amount of organic plasticizer added as described herein.

Method of Making the Abrasive Article

The first step to make the abrasive article is to prepare the abrasive slurry. The abrasive slurry is made by combining together by any suitable mixing technique the binder precursor, the plasticizer, the abrasive particles, and the optional additives. Examples of mixing techniques include low shear and high shear mixing, with high shear mixing being preferred. Ultrasonic energy may also be utilized in combination with the mixing step to lower the abrasive slurry viscosity. Typically, the abrasive particles are gradually added into the binder precursor. The amount of air bubbles in the abrasive slurry can be minimized by pulling a vacuum during or after the mixing step. In some instances it is preferred to heat, generally in the range of 30° to 70° C. the abrasive slurry to lower the viscosity. It is important the abrasive slurry has a rheology that coats well and in which the abrasive particles and other fillers do not settle.

There are two main methods of making the abrasive article of this invention. The first method generally results in an abrasive composite that has a precise shape. To obtain the precise shape, the binder precursor is solidified or cured while the abrasive slurry is present in cavities of a production tool. The second method generally results in an abrasive composite that has an irregular shape. In both methods, the abrasive slurry is coated into cavities of a production tool to generate the abrasive composites. However, in the second method, the abrasive slurry is removed from the production tool before the binder precursor is cured or solidified. Subsequent to this, the binder precursor is cured or solidified. Since the binder precursor is not cured while in the cavities of the production tool this results in the abrasive slurry flowing and distorting the abrasive composite shape. For both methods, as a thermosetting binder precursor curable by free radical mechanism is employed, the energy source can be thermal energy or radiation energy depending upon the binder precursor chemistry.

Production Tool

The production tool contains a plurality of cavities. These cavities are essentially the inverse shape of the abrasive composite to be formed and are responsible for generating the shape of the abrasive composites. It is preferred that there are at least 700 cavities per square centimeter, preferably at least 1,500; more preferably at least 3,000 and most preferably at least 7,500 cavities per square centimeter. This number of cavities results in the forming of an abrasive article having a corresponding number of abrasive composites/square centimeter. These cavities can be any be shape, but it is preferably a geometric shape such as a pyramid, truncated pyramid, cubic, rectangular, prismatic, conical, truncated conical or a cylinder or post-like feature having a top surface shape of triangle, square, rectangle, hexagon, octagon, or the like. The cavities can be present in a dot like pattern with spaces between adjacent cavities or the cavities can butt up against one another. It is preferred that the cavities butt up against one another. Additionally, the shape of the cavities is selected such that the surface area of the abrasive composite decreases away from the backing.

The production tool can be a belt, a sheet, a continuous sheet or web, a coating roll such as a rotogravure roll, a sleeve mounted on a coating roll, or die. The production tool can be composed of metal, (e.g., nickel), metal alloys, ceramic, or plastic. The metal production tool can be fabricated by any conventional technique such as engraving, hobbing, electroforming, diamond turning, knurling, and the like. A copper tool can be diamond turned and then a nickel metal tool can be electroplated of the copper tool. A thermoplastic tool can be replicated off a metal master tool. The master tool will have the inverse pattern desired for the production tool. The master tool is preferably made out of metal, e.g., nickel. The thermoplastic sheet material can be heated and optionally along with the master tool such that the thermoplastic material is embossed with the master tool pattern by pressing the two together. The thermoplastic can also be extruded or cast onto to the master tool and then pressed. The thermoplastic material is cooled to solidify and produce a production tool.

The production tool may also contain a release coating to permit easier release of the abrasive article from the production tool. Examples of such release coatings include silicones and fluorochemicals.

Energy Sources

The abrasive slurry comprises a free radical curable binder precursor, such that the binder precursor is cured or polymerized. This polymerization is generally initiated upon exposure to a thermal or light radiation energy source. The amount of energy depends upon several factors such as the binder precursor chemistry, the dimensions of the abrasive slurry, the amount and type of abrasive particles and the amount and type of the optional additives. The radiation energy sources include electron beam, ultraviolet light, or visible light. Electron beam radiation, which is also known as ionizing radiation, can be used at an energy level of about 0.1 to about 10 Mrad, preferably at an energy level of about 1 to about 10 Mrad. Ultraviolet radiation refers to non-particulate radiation having a wavelength within the range of about 200 to about 400 nanometers, preferably within the range of about 250 to 400 nanometers. It is preferred that 300 to 600 Watt/inch (118 to 236 Watt/cm) visible lights are used. Visible radiation refers to non-particulate radiation having a wavelength within the range of about 400 to about 800 nanometers, preferably in the range of about 400 to about 550 nanometers. It is also possible to use thermal energy to initiate the free radical polymerization.

Figure 4:
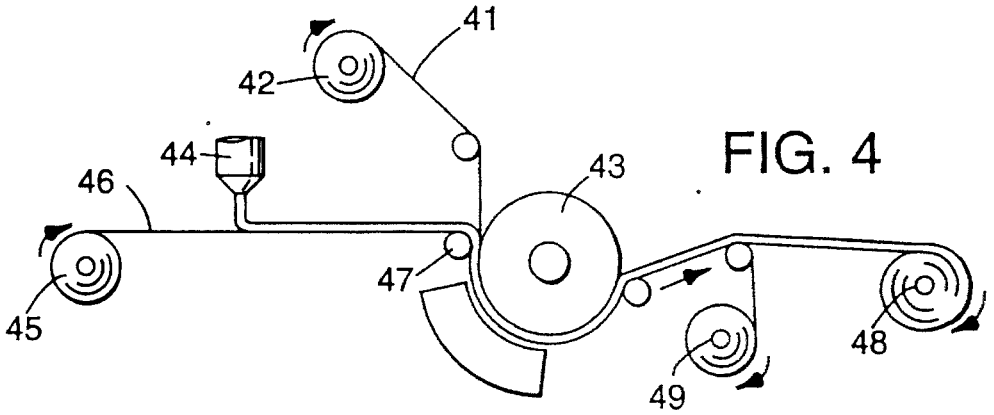
FIG. 4 is a schematic side view showing a system for making an abrasive article of this invention.

The first method, which is preferred, is illustrated in FIG. 4. Backing 41 leaves an unwind station 42 and at the same time the production tool (pattern tool) 46 leaves an unwind station 45. Production tool 46 is coated with abrasive slurry by means of coating station 44. It is possible to heat the abrasive slurry and/or subject the slurry to ultrasonics prior to coating to lower the viscosity. The coating station can be any conventional coating means such as drop die coater, knife coater, curtain coater, vacuum die coater or a die coater. During coating the formation of air bubbles should be minimized. The preferred coating technique is a vacuum fluid bearing die. After the production tool is coated, the backing and the abrasive slurry are brought into contact by any means such that the abrasive slurry wets the front surface of the backing. In FIG. 4, the abrasive slurry is brought into contact with the backing by means of contact nip roll 47. It is preferred that a rolling bank or bead of abrasive slurry is maintained on the production tool at nip roll 47 to ensure even coating. Contact nip roll 47 also forces the resulting construction against support drum 43. Next, some form of energy is transmitted into the abrasive slurry to at least partially cure the binder precursor. The term partial cure is meant that the binder precursor is polymerized to such a state that the abrasive slurry does not flow from an inverted tool. The binder precursor can be fully cured once it is removed from the production tool by any energy source. Following this, the production tool is rewound on mandrel 49 so that it can be reused again. The abrasive article is wound on mandrel 48. If the binder precursor is not fully cured, the binder precursor can then be fully cured by either time and/or exposure to an energy source. Additional steps to make the abrasive article according to this first method is further described in U.S. Pat. No. 5,152,917 (Pieper et al.), and U.S. Ser. No. 08/004,929 (Spurgeon et al.), filed Dec. 30, 1993, now allowed, which are incorporated by reference.

In another variation of this first method, the abrasive slurry can be coated onto the backing and not into the cavities of the production tool. The abrasive slurry coated backing is then brought into contact with the production tool such that the abrasive slurry flows into the cavities of the production tool. The remaining steps to make the abrasive article are the same as detailed above.

Relative to this first method, it is preferred that the binder precursor is cured by radiation energy. The radiation energy can be transmitted through the backing or through the production tool. The backing or production tool should not appreciably absorb the radiation energy. Additionally, the radiation energy source should not appreciably degrade the backing or production tool. For instance ultraviolet light can be transmitted through a polyester backing. Alternatively, if the production tool is made from certain thermoplastic materials, such as polyethylene, polypropylene, polyester, polycarbonate, poly(ether sulfone), poly(methyl methacrylate), polyurethanes, polyvinylchloride, or combinations thereof, ultraviolet or visible light can be transmitted through the production tool and into the abrasive slurry. The more deformable material results in easier processing. For thermoplastic based production tools, the operating conditions for making the abrasive article should be set such that excessive heat is not generated. If excessive heat is generated, this may distort or melt the thermoplastic tooling.

Figure 5:
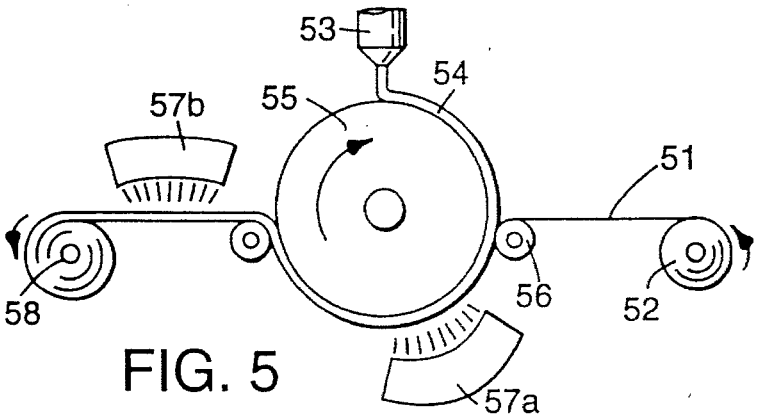
FIG. 5 is a schematic side view showing an alternate system for making an abrasive article of this invention.
Figure 3:
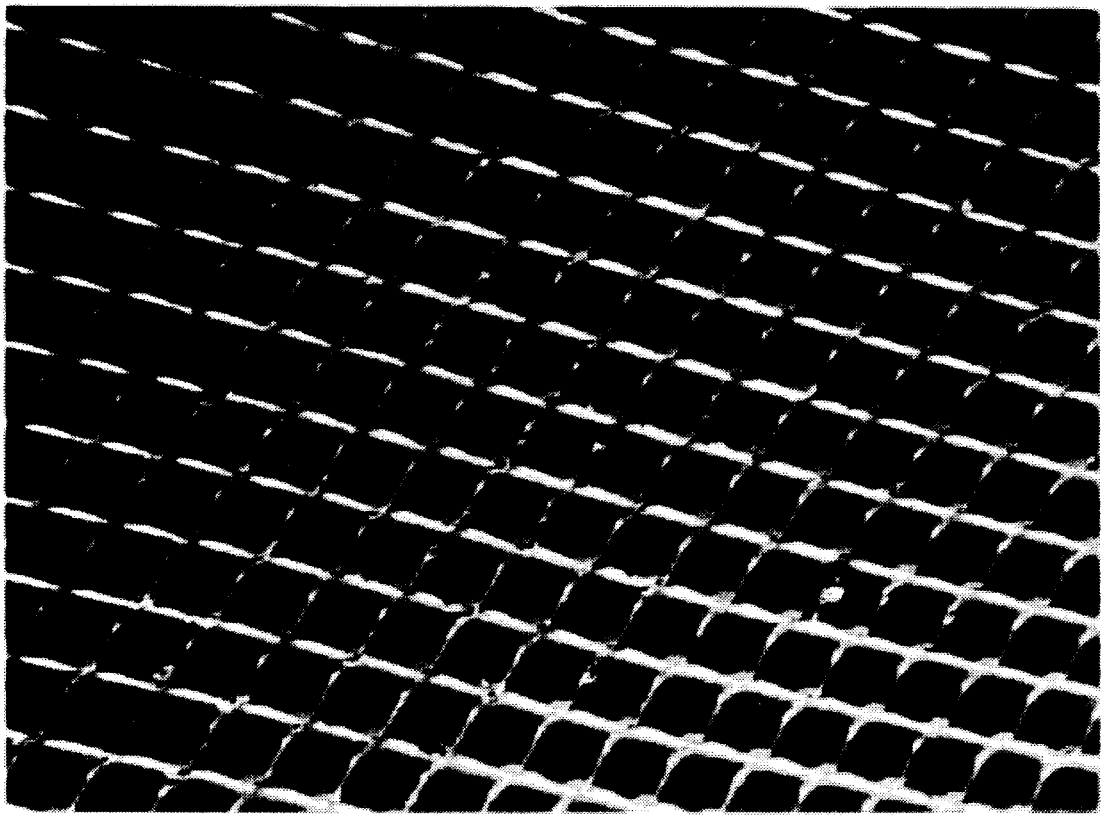
FIG. 3 is an enlarged view of the top surface of an abrasive article of this invention taken on a scanning electron photomicrograph (10X).

A second method is illustrated in FIG. 5. Abrasive slurry 54 is coated onto the production tool 55 (shown here as a drum) by means of the coating station 53. The abrasive slurry can be coated onto the production tool by any technique such as drop die coater, roll coated, knife coater, curtain coater, vacuum die coater, or a die coater. During coating the formation of air bubbles should be minimized. Backing 51 leaves an unwind station 52, and the production tool and the abrasive slurry are brought into contact with backing 51 by a nip roll 56 such that the abrasive slurry wets the backing. The abrasive slurry coated backing is exposed to an energy source 57A to initiate the polymerization of the binder precursor and thus forming the abrasive composites. Next, the abrasive article is removed from the production tool. After removal, the resulting abrasive article is wound onto a roll at station 58.

In another variation of this second method, the abrasive slurry can be coated into the onto the backing and not into the cavities of the production tool. The backing is then brought into contact with the production tool such that the abrasive slurry fills the cavities of the production tool. The remaining steps to make the abrasive article are the same as detailed above.

It is also possible that the binder precursor is exposed to the energy source 57B rather than source 57A after removal from the production tool 55. This method results in composite shapes which are somewhat sagged, such as depicted in FIG. 2.

After the abrasive article is made, it can be flexed and/or humidified prior to converting. The abrasive article can be converted into any desired form such as a cone, endless belt, sheet, disc, etc, before the abrasive article is used.

Refining a Workpiece Surface

The abrasive article is then used to refine a surface of a workpiece. The term refine means that a portion of the workpiece is abraded away by the abrasive article while the surface finish associated with the workpiece surface is reduced. One typical surface finish measurement is Ra; Ra is the arithmetic average finish generally measured in micro-inches or micrometers. The surface finish can be measured by a profilometer, such as a Perthometer or Surtronic.

Workpiece

The workpiece to be reduced by the abrasive article of this invention can be chosen from diverse types of material such as metal, metal alloys, exotic metal alloys, ceramics, glass, wood, wood like materials, composites, painted surface, plastics, reinforced plastic, stones, marble, and combinations thereof. The workpiece may be flat or may have a shape or contour associated with it. The abrasive article of the invention can be flexible enough to accommodate contoured surfaces by appropriate selection of the backing, among other things. Examples of workpieces include glass eye glasses, plastic eye glasses, plastic lenses, glass television screens, metal automotive components, plastic components, particle board, cam shafts, crank shafts, furniture, turbine blades, painted automotive components, magnetic media, and the like.

Depending upon the application, the force at the abrading interface can range from about 0.1 kg to over 1000 kg. Generally this range is between 1 kg to 500 kg of force at the abrading interface. Also depending upon the application, there is generally a liquid present during abrading. This liquid can be water and/or an organic compound. Examples of typical organic compounds include lubricants, oils, emulsified organic compounds, cutting fluids, soaps, or the like. These liquids may also contain other additives such as defoamers, degreasers, corrosion inhibitors, or the like. The abrasive article may oscillate at the abrading interface during use. In some instances, this oscillation may result in a finer surface on the workpiece being abraded.

The abrasive article can be converted into a belt, tape rolls, disc, sheet, and the like. The abrasive disc, which also includes what is known in the abrasive art as "daisies" can range from about 5 cm to 1 m in diameter. Typically abrasive discs are secured to a back-up pad by an attachment means. These abrasive discs can rotate between 100 to 20,000 revolutions per minute, typically between 1,000 to 15,000 revolutions per minute.

The abrasive article of the invention can be used by hand or used in combination with a machine. At least one or both of the abrasive article and the workpiece is moved relative to the other.

A lapping machine that can be used with the abrasive article of the present invention can be any machine designed to accept a fixed abrasive pad, i.e., a lap means. Examples of lapping machines suitable for performing a polishing operation of an ophthalmic lens with an abrasive article of the present invention include: a Coburn 5000 cylinder machine, available from Coburn Optical Industries, Inc., Muskogee, Okla.; a Coburn 506 cylinder machine; and other known machines in the industry. Unit pressures from about 0.7 to 1.8 kg/cm$^2$ are desired for the present process, with 1.3 to 1.5 kg/cm$^2$ being most preferred. However, the unit pressure is usually partially dictated by the equipment used. The unit pressure on the abrasive article is believed to aid in the breakdown or erosion of the abrasive article being used, and this will be different for every type of abrasive article. Overall, the pressure used will depend on the lapping equipment used, the initial surface finish of the workpiece, the abrasive particle size, and the desired final surface finish of the workpiece.

The time devoted to ophthalmic lens finishing is usually 30 seconds to 6 minutes, with 2 to 3 minutes most common. The actual time need for lens finishing depends on the pressure being used, initial surface finish of the lens, the abrasive particle size, and the desired final surface finish of the lens. An experienced machine operator will be able to determine the correct time and pressure required to obtained the desired final finish.

The lap means is flooded with water during the lapping procedure using the abrasive article of the present invention. The aqueous flow applied in using the abrasive sheet or pad of this invention is preferably predominantly water but may also include other ingredients as typically used in employed in slurry polishing or in conventional coated abrasive finishing. Such additives may include water soluble oils, emulsifiable oils, wetting agents, and the like. The aqueous flow is at least essentially free of abrasive particles, and preferably contains no abrasive particles.

The water flow supplied at the interface of the polishing sheet and lens being finished should be relatively large in volume in order to "flood" the polishing surface, i.e., be used in an amount of liquid adequate to cover substantially all surfaces at the abrading interface. This supply of water can be effected by a water hose and nozzle directing a stream of water at the interface to provide a presence of liquid in and at that vicinity.

The following non-limiting examples will further illustrate the invention. All parts, percentages, ratios, etc, in the examples are by weight unless otherwise indicated.

EXAMPLES

The following abbreviations are used throughout:

TMPTA: trimethylol propane triacrylate, available from Sartomer under the trade designation "SR 351";

PEG: polyethylene glycol, commercially available from Union Carbide under the trade designation Carbowax "600";

PH2: 2-benzyl-2-N,N-dimethylamino-1-(4-morpholinophenyl)-1-butanone, commercially available from Ciba Geigy Corp. under the trade designation "Irgacure 369";

ASF: amorphous silica filler, commercially available from DeGussa under the trade designation "Aerosil 130";

WAO: white aluminum oxide, JIS grade 6000, 2 micrometers average particle size, available from Fujimi Corp.

SCA: silane coupling agent, 3-methacryloxypropyl trimethoxysilane, commercially available from Union Carbide under the trade designation "A-174".

Test Procedure 1

Test Procedure 1 was designed to test the abrasive article for ophthalmic lens polishing. The abrasive samples were cut with a standard die into 3 inch (about 7.6 cm) diameter "daisies". The lens workpiece was made of "CR-39" plastic, available from Pittsburgh Paint & Glass (PPG), Pittsburg, Pa. USA. It was 68 mm in diameter and was pre-ground to a 212 spherical curve (2.12 Diopter). The backside of the abrasive material to be tested was laminated with a pressure-sensitive adhesive and adhered over a lapping block. The lapping machine used was a Coburn 5000 cylinder machine, available from Coburn Optical Industries, Inc., Muskogee, Okla. USA, with a setting of 20 pounds force (about 4.5 Newton) used to urge the lap means and abrasive article against the surface of the lens workpiece. The lap block and lens was flooded with water during polishing. The water flooding was effected by projecting a continuous stream of water into the interface of the contacting lap block and lens workpiece.

A one step fining operation was first performed. The lens was fined for one minute with a 4 micrometer aluminum oxide beaded lapping film commercially available from Minnesota Mining and Manufacturing under the trade designation 3M 356M Qwik Strip™ fining pad. The exemplary abrasive article material, described below, was then used to polish the lens for two minutes under the same conditions as the second fining step.

Rtm

Rtm is a common measure of roughness used in the abrasives industry; it is defined as the mean of five individual roughness depths of five successive measuring lengths, where an individual roughness depth is the vertical distance between the highest and lowest points in a measuring length. Rtm is measured with a profilometer probe, which is a diamond tipped stylus, and the results are recorded in micrometers. In general, the lower the Rtm, the smoother the finish. The profilometer used was a Perthen M4P, with a 0.005 mm radius tip and a measuring stroke of 8.0 mm.

Examples 1–3 and Comparative Example A

Example 1–3 and Comparative Example A were prepared from the following abrasive slurry formulations, where the amounts are expressed in weight percentages (%) of the total mixture.

TABLE 1

| | 1 | 2 | 3 | A |
|---|---|---|---|---|
| TMPTA | 26.9 | 29.1 | 21.7 | 38.4 |
| PEG | 11.5 | 19.4 | 18.5 | 0 |
| PEG/TMPTA | 30/70 | 40/60 | 46/54 | 0/100 |
| PH2 | 0.39 | 0.5 | 0.5 | 0.39 |
| SCA | 1.0 | 1.0 | 1.0 | 1.0 |
| ASF | 1.5 | 1.0 | 1.0 | 1.5 |
| WAO | 58.7 | 49.0 | 57.3 | 58.7 |

Each abrasive slurry was coated with a knife coater for all tests, except Example 2 where coating was performed with a vacuum die coater, at a speed of about 4.6 meters/minute onto a polypropylene production tool having a truncated pyramidal type pattern such that the abrasive slurry filled recesses in the tool. The pyramidal pattern was such that their bases were butted up against one another. The height of the truncated pyramids was about 80 micrometers (3.15 mils), the base was about 178 micrometers (7 mils) per side, and the top was about 51 micrometers (2 mils) per side. There were about 113 lines per inch (about 44 lines per centimeter). A 250 micrometer thick paper backing was pressed against the production tool by means of a roller and the abrasive slurry wetted the front surface of the backing. The article was cured by passing the tool together with the backing and binder precursor once under a 236W/cm "V-bulb" (available from Fusion Systems Co.) at a speed of about 45.7 meters/minute. The radiation passed through the production tool. This visible light resulted in the abrasive slurry being transformed into an abrasive composite and the abrasive composite being adhered to the paper substrate. Next, the paper/abrasive composite construction was separated from the production tool to form an abrasive article.

The Table 2 below shows the results in micrometers from Example 1 and Comparative Example A when tested according to Test Procedure 1.

TABLE 2

| | Rtm |
|---|---|
| Example 1 | 0.23 |
| Bxample 2 | 0.23 |
| Example 3 | 0.20 |
| Comparative Example A | 0.28 |

The results indicate that the provision of the polyethylene glycol in an amounts of at least 30% as admixed with the binder precursor in the abrasive composite show significant improvements in the surface finish achieved.

Examples 4–7 and Comparative Examples AA, B

The test was prepared the same as Examples 1–3 and Comparative Example A, except for the following changes:

The bases of the pyramids did not abut;

The cure speed was 15.2 meter/min. (50 fpm);

The tool has only about 113 lines per inch (44.5 lines/cm);

The slurry formulations were formulated according to Table 3 and tested according to Test Procedure 1.

TABLE 3

| | AA | B | 4 | 5 | 6 | 7† |
|---|---|---|---|---|---|---|
| TMPTA | 197 | 167.5 | 137.9 | 118.2 | 98.5 | 137.9 |
| PEG (L7500) | 0 | 29.6 | 59.1 | 78.8 | 98.5 | 0 (59.1) |
| PEG/TMPTA (L7500/TMPTA) | 0/100 | 15/85 | 30/70 | 40/60 | 50/50 | (30/70) |
| PH2 | 2 | 2 | 2 | 2 | 2 | 2 |
| SCA | 4 | 4 | 4 | 4 | 4 | 4 |
| WAO | 197 | 197 | 197 | 197 | 197 | 197 |

†For Example 7, the PEG was replaced with 59.1 parts "L7500" which is Silwet ™ L-7500, manufactured by Union Carbide Co., an $H_2O$-insoluble silicon oil, to formulate a 30/70 mixture of Silwet ™ L-7500/TMPTA.

TABLE 4

Results - Ophthalmic Polishing

| | Rtm |
|---|---|
| Example AA | 23.2 |
| Example B | 21.0 |
| Example 4 | 15.2 |
| Example 5 | 11.1 |
| Example 6 | 7.8 |
| Example 7 | 10.5 |

Example 8 and Comparative Example C

Water Soluble Silicon Oil

Data for the water soluble silicon oil generated per the experimental procedure of Examples 1–3 except for the following changes.

The tool used was not the truncated pyramid tool of Examples 1–3. Instead, it was a 2.5 mil diamond grade tool having pyramidal shaped cavities that were 63.5 μm high (8,850 cavities/$cm^2$).

The formulations for the water soluble silicon oil (Silwet™ L-77) experiment is as follows:

TABLE 5

| | Ex. 8 Wt % with silicon oil | Comp. Ex. C Wt. % w/o silicon oil |
|---|---|---|
| TMPTA | 27.3 | 38.5 |
| Silwet ™ L-77 | 11.7 | 0 |
| Silwet ™ L-77/TMPTA | 31/69 | 0/100 |
| OX-50 | 1 | 1.5 |
| A-174 | 1 | 1 |
| IR-369 | 0.5 | 0.5 |
| WA-6000 | 58.5 | 58.5 |

Results following ophthalmic test procedure:

TABLE 6

| | Rtm (micrometers) |
|---|---|
| Example 8 | 9.5 |
| Comparative Example C | 11.3 |

Various modifications and alterations of this invention will become apparent to those skilled in the art without departing from the scope and spirit of this invention, and it should be understood that this invention is not to be unduly limited to the illustrative embodiments set forth herein.

What is claimed is:

1. An abrasive article comprising a sheet structure having at least one major surface having deployed thereon a plurality of individual abrasive composites, each composite comprising a plurality of abrasive particles dispersed in a plasticized crosslinked binder, and said binder having been formed by crosslinking of binder precursor via an addition polymerization mechanism, wherein said binder precursor is combined with plasticizer prior to said crosslinking in an amount of 30 to 70 parts plasticizer per 100 parts by weight of said combined binder precursor and plasticizer, wherein said composites each have a precise shape defined by a distinct and discernible boundary and each composite further comprises a distal end that is spaced from said major surface and is unconnected to any other composite.

2. The abrasive article of claim 1, wherein said plasticizer is a polyol.

3. The abrasive article of claim 1, wherein said plasticizer comprises a polyol selected from the group consisting of polyethylene glycol, methoxypolyethylene glycol, polypropylene glycol, polybutylene glycol, glycerol, polyvinyl alcohol, and combinations thereof.

4. The abrasive article of claim 1, wherein said plasticizer comprises a polyalkylene glycol.

5. The abrasive article of claim 4, .wherein said polyalkylene glycol is a polyethylene glycol.

6. The abrasive article of claim 5, wherein said polyethylene glycol has an average molecular weight of from 200 to 10,000.

7. The abrasive article of claim 1, wherein said plasticizer comprises polyethylene glycol and is combined with said binder precursor in an amount of 30 to 50 parts plasticizer per 100 parts by weight of said combined binder precursor and plasticizer.

8. The abrasive article of claim 1, wherein said binder precursor is crosslinked via a free radical mechanism.

9. The abrasive article of claim 1, wherein said binder precursor is selected from the group consisting of acrylated urethanes, acrylated epoxies, ethylenically unsaturated compounds, aminoplast derivatives having pendant α,β-unsaturated carbonyl groups, isocyanurate derivatives having at least one pendant acrylate group, isocyanate derivatives having at least one pendant acrylate group, and combinations thereof.

10. The abrasive article of claim 1, wherein said binder precursor comprises an ethylenically unsaturated compound.

11. The abrasive article of claim 10, wherein said ethylenically unsaturated compound comprises an acrylate monomer.

12. The abrasive article of claim 11, wherein said binder precursor comprises trimethylolpropane triacrylate.

13. The abrasive article of claim 1, wherein said abrasive particles are a material selected from the group consisting of aluminum oxide, silicon carbide, chromia, alumina zirconia, silica, diamond, iron oxide, ceria, boron nitride, boron carbide, garnet, and combinations thereof.

14. The abrasive article of claim 1, wherein said abrasive particles have a Mohs' hardness of at least 8 and a particle size of from about 0.1 to 500 micrometers.

15. The abrasive article of claim 14, wherein said abrasive size particles have a size of from 0.1 to 5 micrometers.

16. An abrasive article comprising a sheet structure having at least one major surface having deployed thereon an abrasive material comprising a plurality of abrasive particles dispersed in a plasticized crosslinked binder, and said binder having been formed by crosslinking of binder precursor via an addition polymerization mechanism, wherein said abrasive material is provided as a discontinuous raised pattern formed of a plurality of elongated three-dimensional formations extending from said major surface which define areas having no abrasive material, wherein said binder precursor is combined with plasticizer prior to said crosslinking in an amount of 30 to 70 parts plasticizer per 100 parts by weight of said combined binder precursor and plasticizer.

* * * * *

UNITED STATES PATENT AND TRADEMARK OFFICE

CERTIFICATE OF CORRECTION

PATENT NO.: 5,453,312

DATED: September 26, 1995

INVENTOR(S): John D. Haas, Todd J. Christianson and Wesley J. Bruxvoort

It is certified that error appears in the above-identified patent and that said Letters Patent is hereby corrected as shown below:

Col. 1, line 15 "as" should read --an--

Col. 2, line 6 "5,152,417" should read --5,152,917--

Col. 2, line 10 "5,152,179" should read --5,152,917--

Col. 5, lines 13-14 "invloves" should read --involves--

Col. 10, Formula I

"

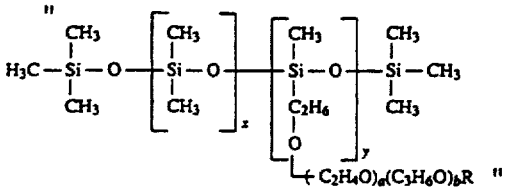

I should read

--

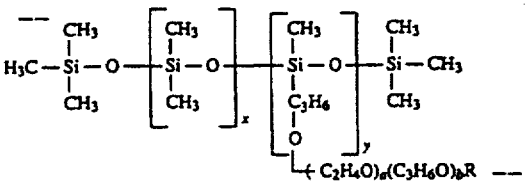

I --

Col. 10, line 22 "plasticier" should read --plasticizer--

Col. 15, line 20 after "breakdown" insert --of--

Col. 16, line 50 delete "to"

UNITED STATES PATENT AND TRADEMARK OFFICE

CERTIFICATE OF CORRECTION

PATENT NO.: 5,453,312

DATED: September 26, 1995

INVENTOR(S): John D. Haas, Todd J. Christianson and Wesley J. Bruxvoort

It is certified that error appears in the above-identified patent and that said Letters Patent is hereby corrected as shown below:

Col. 17, line 47 "08/004,929" should read --08/175,694--

Col. 18, line 26 delete "into the"

Signed and Sealed this

Sixth Day of May, 1997

*Attest:*

*Attesting Officer*

Bruce Lehman

BRUCE LEHMAN

*Commissioner of Patents and Trademarks*